US008804996B2

(12) United States Patent
Oclee-Brown

(10) Patent No.: US 8,804,996 B2
(45) Date of Patent: Aug. 12, 2014

(54) CONE LOUDSPEAKER

(75) Inventor: Jack Oclee-Brown, Tonbridge (GB)

(73) Assignee: GP Acoustics (UK) Limited, Maidstone (GB)

( * ) Notice: Subject to any disclaimer, the term of this patent is extended or adjusted under 35 U.S.C. 154(b) by 263 days.

(21) Appl. No.: 13/320,859

(22) PCT Filed: May 19, 2010

(86) PCT No.: PCT/GB2010/001006

§ 371 (c)(1),
(2), (4) Date: Mar. 7, 2012

(87) PCT Pub. No.: WO2010/133841

PCT Pub. Date: Nov. 25, 2010

(65) Prior Publication Data

US 2012/0155698 A1 Jun. 21, 2012

(30) Foreign Application Priority Data

May 19, 2009 (GB) ..... 0908542.4

(51) Int. Cl.
*H04R 1/00* (2006.01)

(52) U.S. Cl.
USPC ..... 381/432; 381/396

(58) Field of Classification Search
USPC ..... 381/423, 430, 424, 432, 396; 181/171, 181/173, 174
See application file for complete search history.

(56) References Cited

U.S. PATENT DOCUMENTS 5,323,469 A * 6/1994 Scholz ..... 381/403
5,339,286 A * 8/1994 Esposto ..... 367/140

FOREIGN PATENT DOCUMENTS

| | | | |
|---|---|---|---|
| FR | 37085 | E | 10/1930 |
| GB | 308318 | A | 6/1930 |
| JP | 58083496 | A | 5/1983 |
| JP | 58130698 | A | 8/1983 |
| JP | 62269500 | A | 11/1987 |

OTHER PUBLICATIONS

Abstract, JP58130698, Aug. 4, 1983.
Abstract, JP6226950, Nov. 21, 1987.
Abstract, JP58083496, May 19, 1983.
PCT International Search Report, Sep. 27, 2010.
GB Search Report for application GB0908542.4, Sep. 14, 2009.

* cited by examiner

*Primary Examiner* — Curtis Kuntz
*Assistant Examiner* — Sunita Joshi
(74) *Attorney, Agent, or Firm* — Westman, Champlin & Koehler, P.A.; Z. Peter Sawicki; Amanda Prose

(57) ABSTRACT

A loudspeaker comprising an acoustically radiating diaphragm comprising a generally frustoconical membrane having a narrow neck end and a wide mouth end, stiffening formations for stiffening the radiating membrane and an interface region by which the diaphragm is adapted to be driven; and a transducer comprising a voice coil mounted to drive the diaphragm via its interface region; wherein the interface region is located at the node of the first mode of vibration of the diaphragm.

16 Claims, 6 Drawing Sheets

Fig 4
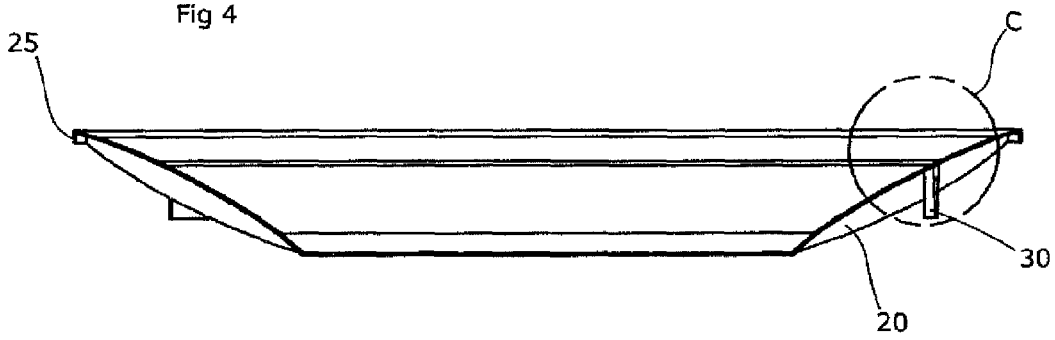
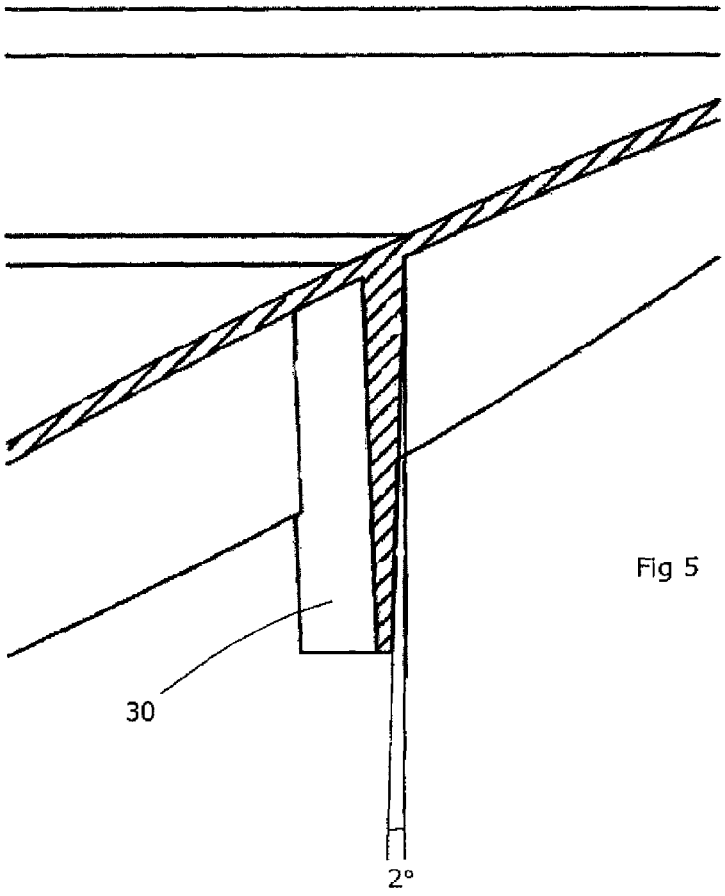
Fig 5

CONE LOUDSPEAKER

CROSS-REFERENCE TO RELATED APPLICATION

This Application is a Section 371 National Stage Application of International Application No. PCT/GB2010/001006, filed May 19, 2010 and published as WO 2010/133841 A1 on Nov. 25, 2010, the content of which is hereby incorporated by reference in its entirety.

FIELD OF THE INVENTION

The present invention relates a loudspeaker having an acoustically radiating diaphragm comprising a generally frustoconical membrane. Such diaphragms are commonly referred to as a loudspeaker "cone".

BACKGROUND ART

The conical geometry is inherently stiff as axisymmetric external forces applied to it manifest themselves as tensional stresses in the material. Advantageously, this permits the successful use of very thin membrane material.

In a competitive marketplace, there is an ever-increasing requirement to obtain improving performance from cone loudspeakers. FIG. 1(*a*) shows views of the cone of a cone loudspeaker, and FIG. 1(*b*) shows its pressure response when neck driven in the conventional manner with a 93 mm diameter mouth end radiating into a 2 pi steradians infinite acoustical region. The pressure is plotted at 46 positions at Im from the loudspeaker and at 2 degree angular increments. It may be seen from FIG. 1(*b*) that above approximately 1.5 kHz the pressure response becomes irregular and resonances appear as the cone is driven beyond the limits of its rigidity and exhibits non-rigid behaviour. Non-rigid behaviour is undesirable at it results in non-uniformity in both the pressure and direction response of the loudspeaker.

It has been long known that the bandwidth of rigidity in a loudspeaker diaphragm may be extended by driving the diaphragm at the node of the first mode of vibration ("nodal driving"). Nodal driving was disclosed in JP57068993 which shows a flat plate diaphragm being driven at the node of the first mode of vibration which, for a circular diaphragm, is a circle around the diaphragm. This approach, although long known, has not, however, been applied to a cone loudspeaker. The geometry of the cone naturally places the node of its first mode of vibration towards its mouth end which would necessitate the use of a large voice coil. The use of a large diameter coil has a negative impact on efficiency and increases the costs of the associated magnet system and coil assembly, which has considerably limited the practicality of nodal driving. The universal practice in the art has hitherto been to drive the cones from their neck.

GB308,318 discloses a loudspeaker with a frusto-conical diaphragm, driven at both the neck of the diaphragm and also at a concentrically-spaced location outside the diaphragm. The intention is to send high-frequency signals to the inner (neck) drive and low-frequency signals to the outer drive which is then located at a node for the high-frequency signal. Thus, it does not in fact suggest nodal driving, as neither drive is located at a node of the diaphragm for the signal that the drive in question is supplying. Nor, indeed, is the diaphragm driven at a node of the first mode of vibration; the node at which it is driven is a node of a higher mode corresponding to the higher frequency drive. Further, no reinforcement of the diaphragm is disclosed, and the outer drive is therefore spaced at a considerable diameter, giving rise to the problems noted above.

U.S. Pat. No. 5,323,469 discloses a loudspeaker with a conical diaphragm driven by a rearwardly extending voice coil former attached to a throat portion of the diaphragm. Additional stabilisation is provided for the diaphragm in the form of a second cone extending radially outwardly from the former, behind the diaphragm, and attaching to the diaphragm at the first nodal point. The interface region by which the voice coil former drives the diaphragm therefore extends between and includes both the throat and the nodal point, and the diaphragm is not therefore nodally driven. The additional stabilisation also extends the depth of the loudspeaker unnecessarily, provides little significant stiffening of the diaphragm away from the nodal point, and is not apt to allow tailoring of the stiffness characteristics of the diaphragm.

SUMMARY OF THE INVENTION

According to a first aspect, the present invention may provide a loudspeaker, comprising;

an acoustically radiating diaphragm forming part of a moving diaphragm assembly and comprising a generally frustoconical membrane having a narrow neck end and a wide mouth end, stiffening formations for stiffening the radiating membrane and an interface region by which the diaphragm is adapted to be driven; and a transducer comprising a voice coil mounted to drive the diaphragm via its interface region;

wherein the interface region is located at a node of the first mode of vibration of the moving diaphragm assembly.

With a suitable arrangement of stiffening formations, the location of the node of the first mode of vibration can be moved up the membrane closer towards its neck end (in comparison with a similar unsupported/unreinforced structure) thereby allowing the diaphragm to be nodally driven using a transducer with a smaller diameter voice coil. The throat end of the diaphragm can then be undriven, or free-floating. Indeed, the neck or throat of the diaphragm is always an anti-node and cannot therefore be a possible location for nodal driving as prescribed by the present invention.

Preferably, the stiffening formations provide a stiffening effect sufficient to dominate the vibrational behaviour of the diaphragm. The arrangement of stiffening formations may be designed such that the node of the first mode of vibration of the diaphragm is positioned at a predetermined position. As the node location is affected by such elements, the moving diaphragm assembly includes such elements as the cone (and stiffening elements), the former, the coil, and (to an extent) items such as the surround and the suspension which may have a small effect on the node location.

Preferably, the predetermined position of the node of the first mode, and hence the position of the interface region, is designed to provide compatibility with a transducer having a voice coil with a standard diameter. By making use of standard components in this way, a loudspeaker in accordance with the present invention may be cost-effectively manufactured.

Preferably, the diaphragm comprises connecting tabs located at the interface region by which the diaphragm is coupled to the transducer.

Preferably, the transducer comprises a former on which the voice coil is mounted, the former being attached to a said connecting tab to drive the diaphragm. An alternative interface could be a cylinder or other suitable shape, although the use of tabs is preference as this allows a reduction in the mass of the moving structure, together with venting of the air cavity inside the voice coil.

Preferably, the stiffening formations comprise ribs. In one embodiment, the stiffening portions comprise a plurality of longitudinal ribs, each longitudinal rib running between the neck end and the mouth end of the radiating membrane and, wherein each longitudinal rib is thinner in depth towards the neck end and/or the mouth end. Thinning the ribs in this way lessens the mass at the extremities of the radiating membrane. The stiffening portions may comprise a circumferential rib at the neck end and/or at the mouth end of the radiating membrane. Circumferential end ribs assist in preventing bell modes.

In preferred embodiments, the diaphragm forms part of a compound loudspeaker; in one arrangement, the loudspeaker further comprises a domed diaphragm mounted at the neck end of the membrane such that the membrane serves a waveguide for the sound radiation emitted by the dome diaphragm in use.

The moving diaphragm assembly will typically also comprise air seals at the neck and mouth ends of the cone, the former, and the voice coil. In practice, we find that the best results are obtainable by modelling not just the cone in isolation, but also any air seals on the inside and outside edges of the cone as these can have an effect on the location of the nodal position. Ultimately, when close to the final result, the former and the voice coil itself can also be included in the calculation of the nodal position of the first mode of resonance.

According to a second aspect, the present invention may comprise a loudspeaker diaphragm for radiating acoustically comprising a generally frustoconical membrane having a narrow neck end and a wide mouth end, stiffening formations for stiffening the radiating membrane and an interface region by which the diaphragm is adapted to be driven, wherein the stiffening formations are arranged so as to locate the node of the first mode of vibration of the diaphragm at a location substantially co-incident with the interface region.

Preferably, the diaphragm comprises connecting tabs at the interface region by which the diaphragm may be coupled to a transducer.

According to a third aspect, the present invention may comprise a method of designing an acoustically radiating loudspeaker diaphragm comprising a generally frustoconical membrane by computer modelling various arrangements of stiffening formations applied to the membrane to place the node of a first mode of vibration of the diaphragm at a location substantially coincident with the desired location of an interface region by which the diaphragm is intended to be coupled to a transducer.

A loudspeaker diaphragm designed in accordance with this aspect of the invention may advantageously be nodally driven using a transducer having a voice coil with a standard or common diameter.

BRIEF DESCRIPTION OF THE DRAWINGS

An embodiment of the present invention will now be described by way of example, with reference to the accompanying figures in which;

FIG. 1(*b*) shows the simulated pressure response of the cone diaphragm of FIG. 1(*a*) when neck driven;

FIG. 4 shows a cross-sectional view along the axis B-B shown in FIG. 2;

FIG. 5 shows an enlarged, close-up view of the detail marked C in FIG. 4;

DETAILED DESCRIPTION OF THE EMBODIMENTS

A cone diaphragm 10 in accordance with a preferred embodiment of the invention is shown in FIGS. 2 to 5.

Figure 3:
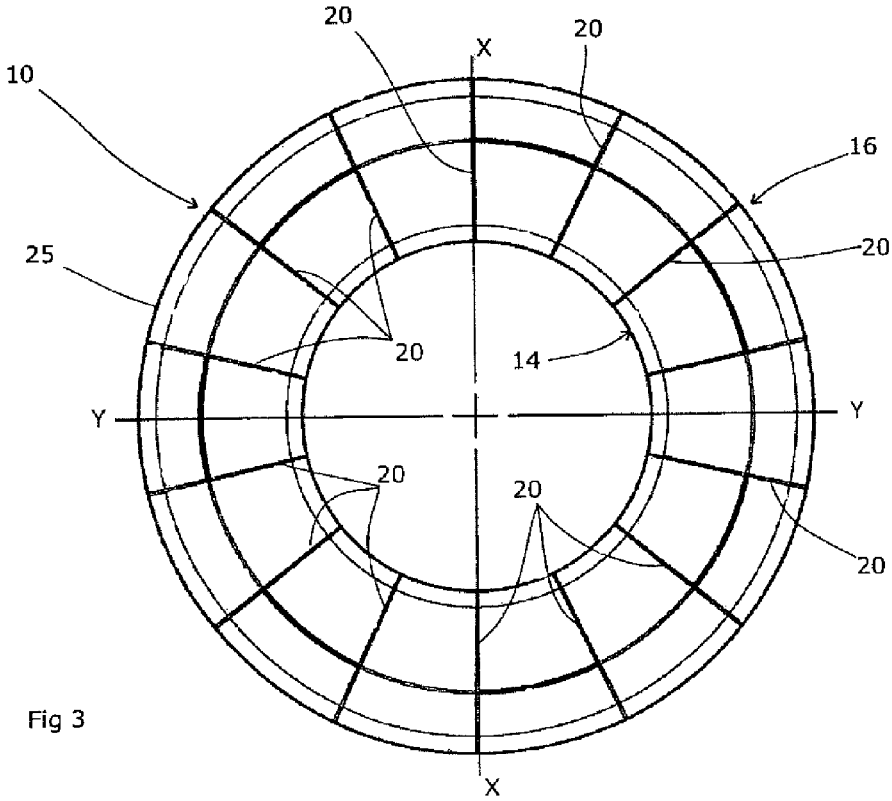
FIG. 3 shows a rear view of the FIG. 2 cone diaphragm.

Referring especially to FIG. 3, the diaphragm 10 comprises a generally frustoconical membrane 12 having its narrow neck end designated 14, its wide mouth end designated 16, and its central longitudinal axis/axis of revolution extending in a direction perpendicular to the axes labelled X and Y. The diaphragm 10 further comprises a plurality of ribs 20 located on the rear surface of the membrane 12 extending longitudinally along its whole length from the neck end 14 to the mouth end 16. Since imaginary extensions of the longitudinal ribs 20 converge at a single point on its central longitudinal axis, the ribs 20 may be said to be radial. The diaphragm 10 further comprises a circumferential rib 25 located at the mouth end 16 of the membrane 12. The function of the ribs 20, 25 is to augment the stiffness of the diaphragm 10 i.e. to increase its resistance to bending. The diaphragm 10 further comprises a plurality of tabs 30 located between each neighbouring pair of ribs 20, the tabs 30 being shaped and positioned so that together they define a circular wall on the rear surface of the membrane 12 partway between its neck and mouth ends 12, 14. The function of the tabs 30 is to provide a means of interfacing/connecting the diaphragm to the voice coil assembly of a driving transducer as described below.

The cone diaphragm 10 is designed by the following methodology. First, the dimensions of a suitable membrane 12 are selected to meet the design specification. Next, one or more target regions are defined on the rear surface of the membrane 12 via which it would be favourable to interface/connect to the voice of the driving transducer. The choice of target region may be dictated, inter alia, by the desire to keep the voice coil diameter as small as possible and also by compatibility with standard or readily available voice coil sizes. Although there is no industry standard mandating sizes as such, it is common or standard practice for voice coil diameters to be at half inch intervals e.g. 12.7 mm, 25.4 mm, 50.8 mm, 76.2 mm and the like. With these parameters set, a computer aided nodal analysis of the diaphragm 10 is performed with various arrangements of ribs applied. The arrangement of ribs is iteratively adjusted until the node of the first mode of vibration coincides with a targeted interface region. Adjustments in the ribs arrangement can be of various forms, including adjusting the number of ribs, the pattern of the ribs and the profile of the individual ribs themselves. It may be seen from FIG. 4 that the ribs 20 do not have constant depth along their length but are shallower towards the extremities. Having established the arrangement of ribs necessary to locate the node of the first mode of vibration of the diaphragm 10 at the desired location, a diaphragm 10 to this specification with connecting tabs positioned at this first mode/interface region is moulded in one piece.

Figure 1A:
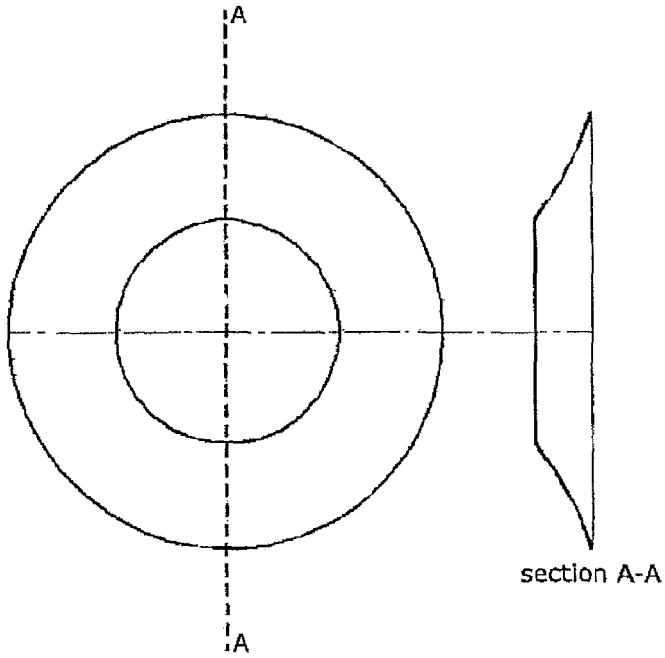
Fig 1a Prior Art
FIG. 1(*a*) shows views of a simple cone diaphragm for a loudspeaker.
Figure 1B:
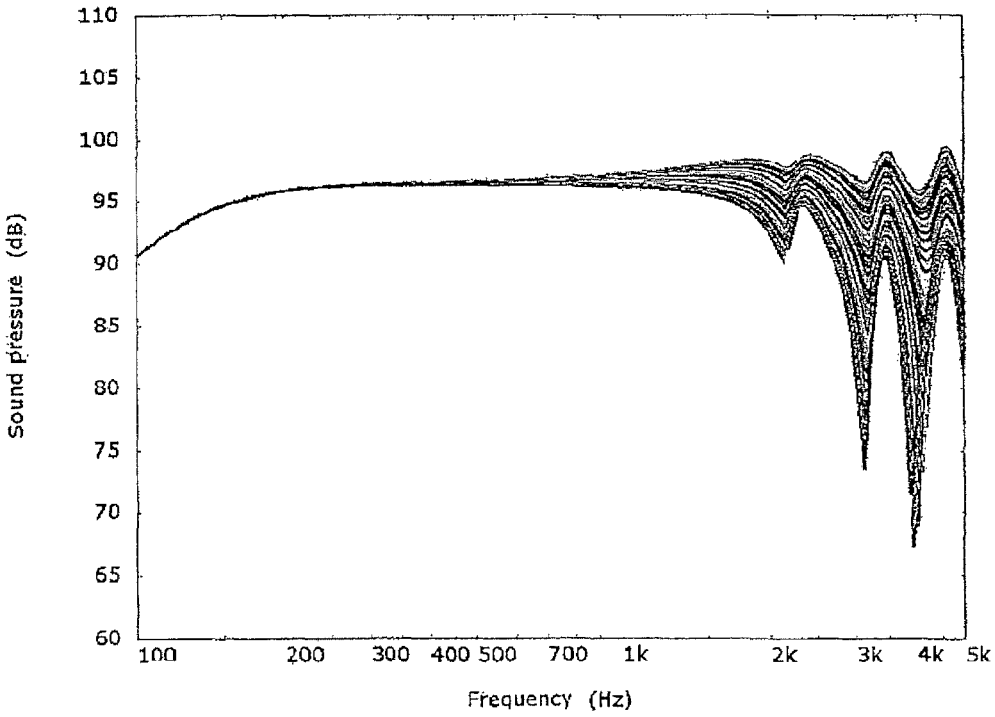
Fig 1b Prior Art
Figure 2:
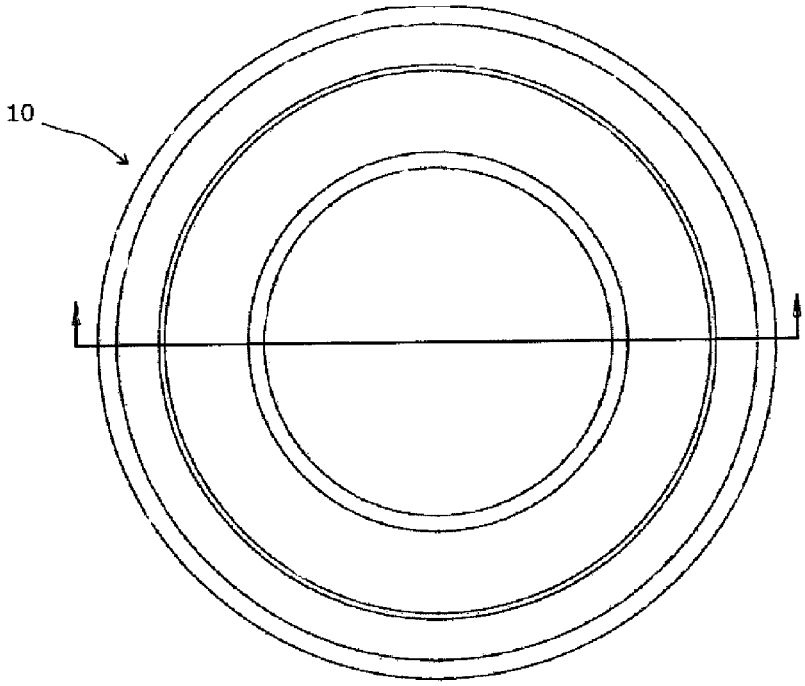
FIG. 2 shows a front view of a cone diaphragm in accordance with an embodiment of the invention.
Figure 6:
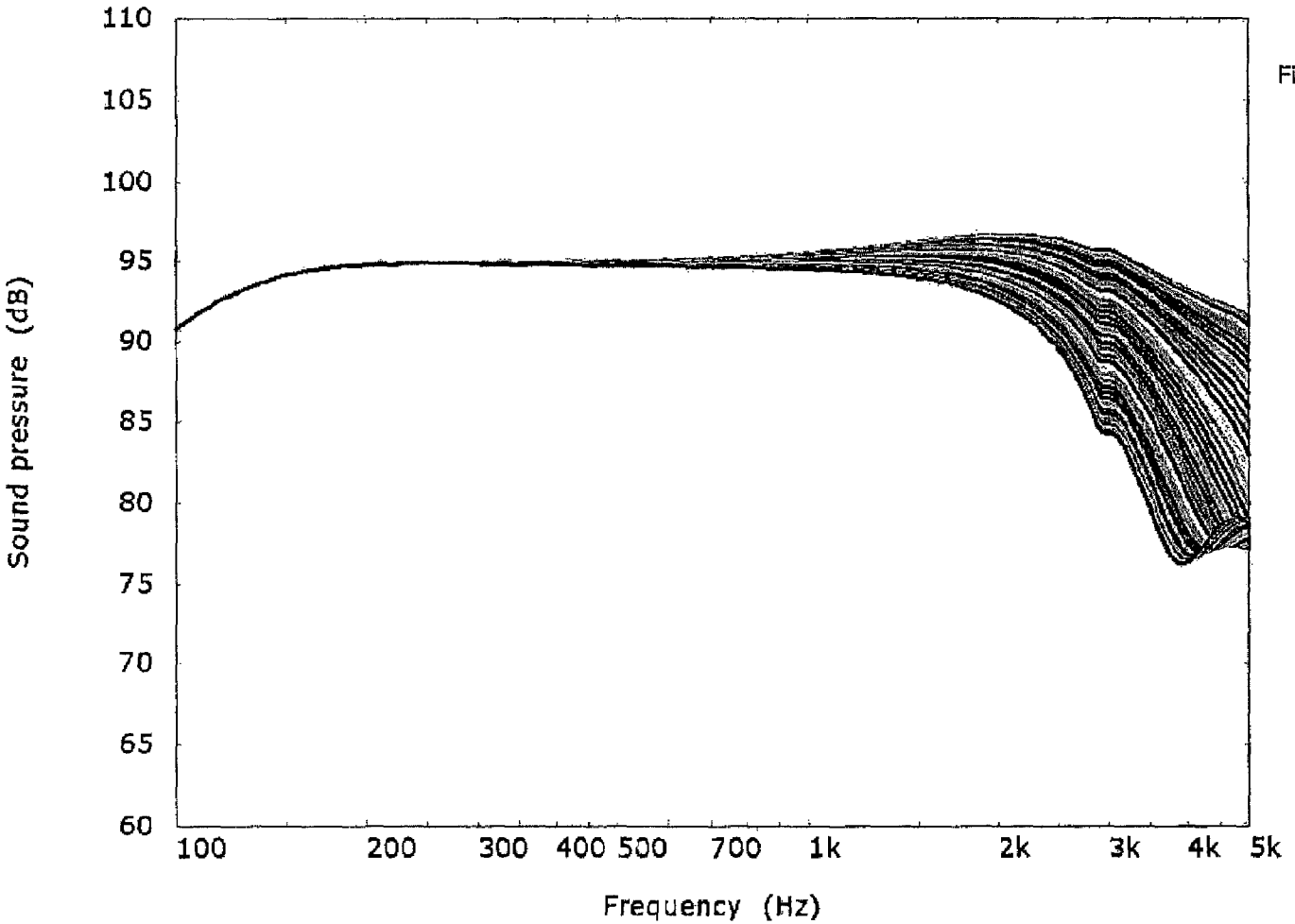
FIG. 6 shows the simulated pressure response of the cone diaphragm featured in FIGS. 2 to 5.

The frustoconical membrane 12 of the diaphragm 10 is identically dimensioned to that of the known unsupported/unreinforced diaphragm shown in FIG. 1(*a*). However, nodal analysis reveals that while the unsupported diaphragm of FIG. 1(*a*) has the node of its first mode of vibration at a location along the membrane which is 0.879 of its diameter (at the mouth end), the node of first mode of vibration of the diaphragm 10 appears at a location along the membrane which is 0.78 of its diameter (at the mouth end). Therefore, the arrangement of ribs 20 applied in accordance with the preferred embodiment of the invention will be understood as having served to shift the node of the first mode of vibration towards the neck end of the membrane thereby permitting a smaller diameter of voice coil to be used. FIG. 6 shows the simulated pressure response of the diaphragm 10 to be a marked improvement over that of the known unsupported/unreinforced diaphragm shown in FIG. 1(*a*). In addition, by nodally driving the diaphragm it is the frequency of the second mode of vibration which becomes limit of rigid behaviour and this is improved substantially by the application of the ribs as shown in the table below.

| | Unsupported cone | Ribbed cone |
|---|---|---|
| Mode 1 | 2268 Hz | 2995 Hz (+32%) |
| Mode 2 | 3414 Hz | 6069 Hz (+77%) |

It is preferred in practising the present invention that the ribs are relatively substantial structure providing a significant stiffening effect, for example, the ribs are preferably at least 2 mm in depth. As the ribs are made more substantial, they come to dominate the vibrational behaviour of the diaphragm. Such an arrangement of ribs is preferred since, in practice, it means that the vibrational behaviour of the diaphragm may be effectively tuned through adjustment of the arrangement of the ribs alone.

Figure 7:
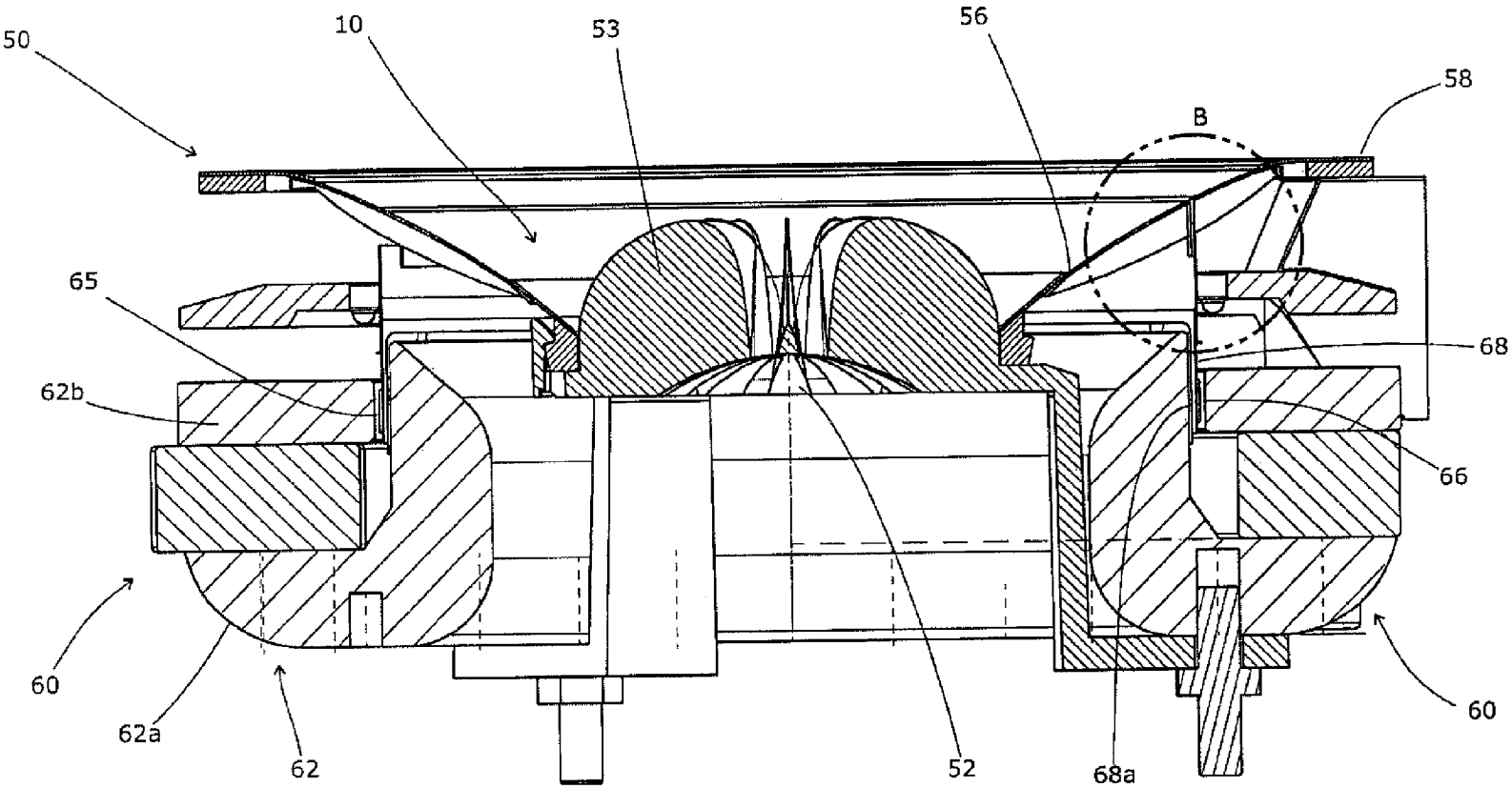
FIG. 7 shows a cross-sectional view of a compound loudspeaker including a diaphragm in accordance with an embodiment of the invention.
Figure 8:
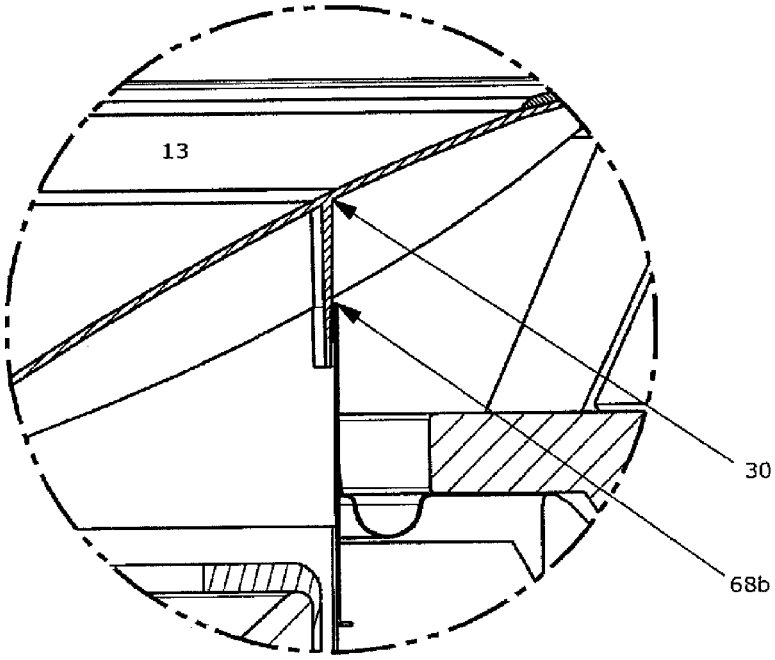
FIG. 8 shows an enlarged, close-up view of the detail marked B in FIG. 8.

FIG. 7 shows the cone diaphragm 10 forming part of a compound loudspeaker generally designated 50. The cone diaphragm 10 is used to emit low frequency sound radiation and also serves as a waveguide for the high frequency radiation emitted by a dome diaphragm 52. The domed diaphragm 52 sits just outside the neck end of the diaphragm 10 behind a phase plug 53. The diaphragms 10, 52 mounted in the way shown present coincident sound sources to the listener. The geometry and arrangement of the domed diaphragm 52 and the cone diaphragm 10 are within the preferred ranges set out in GB 2423908. The phase plug 53 is as described in GB 2437126.

The cone diaphragm 10 is suspended between inner and outer surround seals 56, 58 and driven by a transducer 60. The transducer 60 comprises a yoke 62, having a main portion 62*a* and a top plate portion 62*b*, and a magnet 64 arranged in a magnetic circuit having a gap 65 within which a voice coil assembly comprising a voice coil 66 mounted on a former is arranged to sit. The former 68 comprises a first portion 68*a* which carries the voice coil 66 and resides substantially in the magnetic gap 65 and a second portion 68*b* which extends therefrom to provide a connection to the connecting tabs 30 on the diaphragm 10. The transducer 60 operates conventionally, whereby when a driver current is applied to the coil 66, the coil 66 and the magnet 64 interact magnetically generating a force which causes movement of the former 68 and consequently the diaphragm 10 back and forth along the axis as indicated Z in FIG. 7.

A diaphragm designed in accordance with the methodology described above provides the further advantage that the arrangement of the ribs can be set to compensate for other effects stemming from its practical deployment in a loudspeaker such as, for example, the vibrational effect of adding a flexible seal on the outer edge of the driver.

In other embodiments of the invention, stiffening formations other than ribs may be used. Other shapes which are not generally rib-shaped, for example, honeycomb patterns that are extruded from the surface of the cone may be used. In one embodiment, a sandwich-type construction may provide the required stiffening.

It will of course be understood that many variations may be made to the above-described embodiment without departing from the scope of the present invention.

Although the present invention has been described with reference to preferred embodiments, workers skilled in the art will recognize that changes may be made in form and detail without departing from the spirit and scope of the invention.

The invention claimed is:

1. A loudspeaker comprising:

an acoustically radiating diaphragm forming part of a moving diaphragm assembly and comprising a generally frustoconical membrane having a narrow neck end and a wide mouth end, stiffening formations for stiffening the radiating membrane and an interface region by which the diaphragm is adapted to be driven nodally; and a transducer comprising a voice coil mounted to drive the diaphragm via its interface region;

wherein the interface region is located at a node of the first mode of vibration of the moving diaphragm assembly.

2. The loudspeaker as in claim 1, wherein the stiffening formations dominate vibrational behaviour of the diaphragm.

3. The loudspeaker as in claim 1, wherein the position of the first mode nodal interface region provides compatibility with a transducer having a voice coil with a standard diameter.

4. The loudspeaker as in claim 1, further comprising connecting tabs located at the interface region by which the diaphragm is coupled to the transducer.

5. The loudspeaker as in claim 4, wherein the transducer comprises a former on which the voice coil is mounted, the former being connected to said connecting tabs to drive the diaphragm.

6. The loudspeaker as in claim 5, wherein the former is cylindrical.

7. The loudspeaker as in claim 1, wherein the stiffening formations comprise ribs.

8. The loudspeaker as in claim 7, wherein the stiffening portions comprise longitudinal ribs, each longitudinal rib running between the neck end and the mouth end of the radiating membrane, and each longitudinal rib is thinner in depth towards the neck end and/or the mouth end.

9. The loudspeaker as in claim 7, wherein the stiffening portion comprises a circumferential rib at the neck end and/or mouth end.

10. The loudspeaker as in claim 1, further comprising a domed diaphragm mounted at the neck end of the membrane such that the membrane serves as a waveguide for the sound radiation emitted by the dome diaphragm in use.

11. The loudspeaker as in claim 1, in which the moving diaphragm assembly further comprises at least one of an air seal at the neck end of the cone, an air seal at the mouth end of the cone, the former, and the voice coil.

12. A loudspeaker diaphragm for radiating acoustically comprising a generally frustoconical membrane having a narrow neck end and a wide mouth end, stiffening formations for stiffening the radiating membrane and an interface region by which the diaphragm is adapted to be driven nodally, wherein the stiffening formations are arranged so as to locate a node of the first mode of vibration of the diaphragm at a location substantially co-incident with the interface region.

13. The loudspeaker diaphragm as in claim 12, wherein the stiffening formations dominate the vibrational behaviour of the diaphragm.

14. The loudspeaker diaphragm as in claim 12, wherein the position of first mode/interface region provides compatibility with a transducer having a voice coil with a standard diameter.

15. The loudspeaker diaphragm as in claim 12, further comprising connecting tabs at the interface region by which the diaphragm may be coupled to a transducer.

16. A method of designing an acoustically radiating loudspeaker diaphragm comprising a generally frustoconical membrane by computer modelling various arrangements of stiffening formations applied to the membrane to achieve a node of the first mode of vibration of the diaphragm at a location substantially coincident with the desired location of a nodally driven interface region by which the diaphragm is intended to be coupled to a transducer.

* * * * *